US006111515A

United States Patent [19]

Schaer et al.

[11] Patent Number: 6,111,515

[45] Date of Patent: Aug. 29, 2000

[54] METHOD OF AND APPARATUS FOR PREVENTING ACCIDENTS DURING WORKING WITH HAND-HELD TOOLS WITH A ROTATABLE WORKING TOOL

[75] Inventors: Roland Schaer, Grabs, Switzerland; Peter Hellmann, Obermeitingen; Martin Mayr, Ilmmünster, both of Germany

[73] Assignee: Hilti Aktiengesellschaft, Schaan, Liechtenstein

[21] Appl. No.: 09/452,302

[22] Filed: Dec. 1, 1999

[30] Foreign Application Priority Data

Dec. 10, 1998 [DE] Germany ..... 198 57 061

[51] Int. Cl.[7] ..... G08B 21/00

[52] U.S. Cl. ..... 340/680; 340/679; 340/686.5; 340/689; 408/6; 173/12

[58] Field of Search ..... 340/680, 683, 340/679, 686.1, 689, 665, 686.5; 408/6; 173/12; 360/60

[56] References Cited

U.S. PATENT DOCUMENTS 4,063,600 12/1977 Krzes ..... 173/12
4,866,429 9/1989 Granere ..... 340/680
5,014,793 5/1991 Germanton et al. ..... 173/12
5,235,472 8/1993 Smith ..... 360/60
5,239,479 8/1993 Nolting et al. ..... 364/474.16
5,401,124 3/1995 Hettich ..... 408/6
5,954,457 9/1999 Stock et al. ..... 408/6

*Primary Examiner*—Daniel J Wu
*Assistant Examiner*—Phung Nguyen
*Attorney, Agent, or Firm*—Brown & Wood, LLP

[57] ABSTRACT

A method of and an apparatus for preventing accidents caused by blockage of a rotatable tool when working with a hand-held tool including the rotatable tool (8), a drive motor (7) for driving the rotatable tool (8), and means (5, 6) for interrupting transmission of a drive torque from the drive motor (7) to the rotatable tool (8) dependent on an operational condition of the hand-held tool, with the method including determining the operational condition of the hand-held tool by measuring displacement of the hand-held tool in space in at least two points of the hand-held tool spatially spaced from each other and spaced from a tool axis; subtracting two obtained displacement measurement variable ($a_1$, $a_2$) from each other; and thereafter, calculating an actuation signal that actuates the interrupting means (5, 6); and with the apparatus including sensors and an evaluation circuit for implementing the method.

8 Claims, 2 Drawing Sheets

METHOD OF AND APPARATUS FOR PREVENTING ACCIDENTS DURING WORKING WITH HAND-HELD TOOLS WITH A ROTATABLE WORKING TOOL

BACKGROUND OF THE INVENTION

1. Field of the Invention

The present invention relates to a method of and an apparatus for preventing accidents caused by blockage of a rotatable tool when working with a hand-held tool including the rotatable tool, a drive motor for driving the rotatable tool, and means for interrupting transmission of a drive torque from the drive motor to the rotatable tool dependent on an operational condition of the hand-held tool determined with a displacement measurement device.

2. Description of the Prior Art

Accidents, which are caused by rotatable tools, in particular injuries in the region of the wrist or the arm, or fall of ladders, of a scaffold and so on, often results from a sudden blockage of the rotatable tool and by a resulting rapid increase of the reaction torque of hand-held tool equipped with the rotatable tool, in particular, when a high-power hand-held tool, such as a drill hammer is used. The danger of such accidents was recognized since long ago. Different solutions for solving the problems associated with the blockage of a rotatable tool have been disclosed, e.g., in European Publication EP 150 669 A2 and in International Publication WO 88/06508 A3. Accordingly to these solutions, by using a torsional sensor, in particular, an acceleration sensor arranged in or on a hand-held tool housing, which senses acceleration or outer pivotal movement or displacement of a hand-held tool and generates an appropriate output signal, a drive train between a drive motor and the rotatable tool, in particular, between the drive train and the rotary spingle is broken, when in accordance with a predetermined criterium, e.g., an acceleration threshold, a clutch is actuated when the output signal of the sensor exceeds the predetermined criterium. The drawbacks of these solutions, which are proposed in the above-mentioned prior art, consist in an erroneous actuation of the clutch even at a normal operation of a hand-held tool, e.g., during the use of a hammer drill for drilling in a concrete mass having an unhomogeneous composition. This is associated basically with an immediate evaluation of the sensor output signal without a preliminary assessment of the signal, i.e., evaluation of the output signal using inevitably comparatively low threshold values, without an individual assessment of a respective signal.

A significant improvement was achieved by using an evaluation method with a preliminary assessment for signals outputted by an acceleration sensor, which is described in German Patent No. 4,344,817. The improved method consists in calculating in advance, based on a rotational acceleration variable which is generated by an acceleration sensor based on a reaction torque caused by blockage or partial blockage of the rotatable tool, and on a predetermined time constant, an expected twist angle of the hand-held tool, and in actuating the safety clutch when the calculated or expected twist angle exceeds a predetermined maximum allowable twist angle. Thereby, a future blockage of the hand-held tool is evaluated immediately after an occurrence of a blockage, and counter-measures are undertaken when the hand-held tool is subjected to a rotary pulse capable of causing an accident.

However, the experiments have shown that the method described in German patent No. 4,344,817, though advantageous, has two serious drawbacks, namely:

(i) the rotational axis of the tool often, at the critical point of the blockage, does not coincide with the tool axis; and (ii) the acceleration caused by gravity influences the measurement signal of the acceleration sensor dependent on an immediate position of the tool.

Accordingly, an object of the present invention is to improve a hand-held tool of the type described above in such a way that a measurement signal, which is generated by an acceleration sensor or sensors in response to a reaction pulse or a reaction torque upon blockage of the working tool, provides an unambiguous information whether a dangerous blockage has occurred when the rotational axis of the tool becomes twisted.

Another object of the present invention is to improve the hand-held tool of the type described above in such a way that the influence of the gravity acceleration on the measurement signal is eliminated.

SUMMARY OF INVENTION

These and other objects of the present invention, which will become apparent hereinafter, are achieved by providing a method of preventing accidents caused by blockage of a rotatable tool when working with a hand-held tool including the rotatable tool, a drive motor for driving the rotatable tool and an element for interrupting transmission of a drive torque from the drive motor to the rotatable tool dependent on an operational condition of the hand-held tool, with the method including determining the operational condition of the hand-held tool by measuring displacement of the hand-held tool in space in at least two points of the hand-held tool spatially spaced from each other and spaced from a tool axis; subtracting two obtained displacement measurement variable from each other; and thereafter, calculating an actuation signal that actuates the interrupting element, and by providing an apparatus for effecting the method and including at least two sensors located in the hand-tool housing and which are spatially spaced from each other and from a tool axis for measuring displacement of the hand-held tool in space in two points at which the sensors are located and an electronic evaluation device for processing displacement measurement variables generated by the least two sensors and including a subtraction stage for subtracting the generated displacement measurement variables from each other before calculating an actuation signal for actuating the interrupting element.

Subtracting, according to the inventive method, the two measurement variable from each other before calculating an actuation signal for actuating the interruption means constitute a most significant improvement of the inventive method over that disclosed in German Patent No. 4,344,817.

The calculation of the expected twist angle, the reduction or the elimination of the low and high frequency disturbances, and the suitable mathematical principles and algorithms for the calculation of the to-be-expected critical twist angle are described in detail in German Patent No. 4,344,817 which is incorporated herein by reference thereto.

The novel features of the present invention, which are considered as characteristic for the invention, are set forth in particular in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1A:
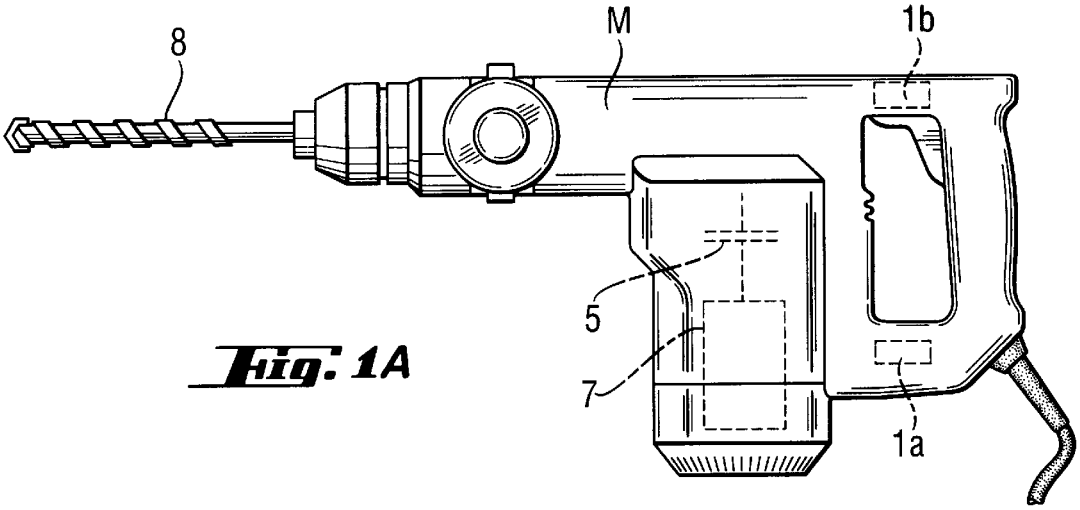
FIG. 1A a side view of a hammer drill illustrating an example of a hand-held tool equipped with two acceleration sensors.
Figure 1B:
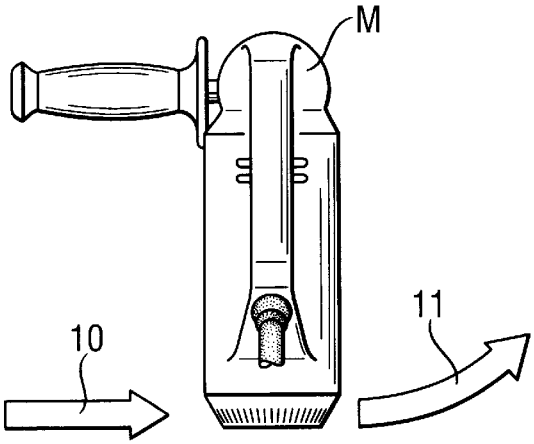
FIG. 1B a rear view of the hammer drill shown in FIG. 1A.
Figure 2:
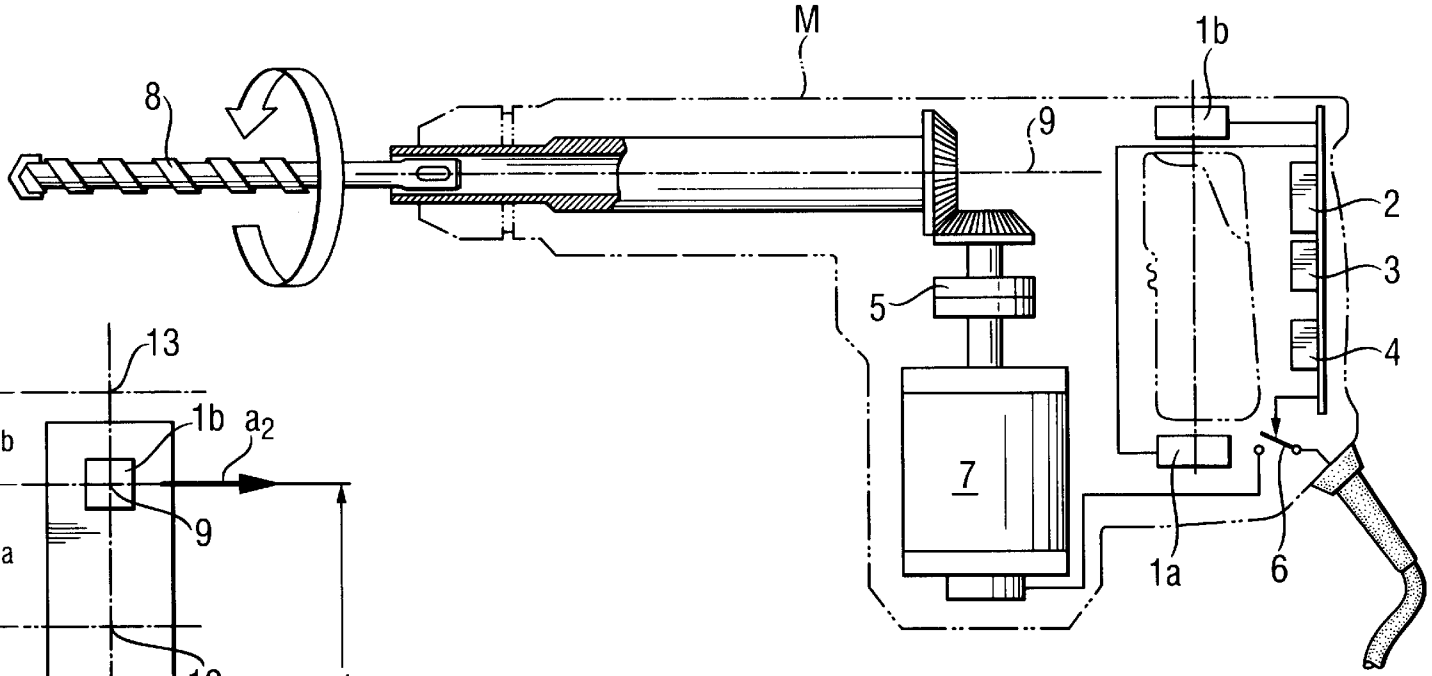
FIG. 2 a schematic, partially cross-sectional side view of the hammer drill shown in FIGS. 1A and 1B.

FIGS. 1A, 1B, and 2 show essential, for the present invention, elements of a hand-held tool M the operational conditions of which is monitored with two acceleration sensors 1*a* and 1*b*. In FIG. 1B, two arrows 10, 11 show, respectively, a deflection force or acceleration and a deflection direction in case of blocking of a working tool 8. The signals of the acceleration sensors 1*a* and 1*b* are communicated to an electronic evaluation device 3 via input interface 1 for signal conditioning, analog/digital conversion and the like. The electronic evaluation device 3 can be formed as a micro-processor, an electronic microcomputer, a signal processor and the like. In the evaluation device 3, the digital signals of the two acceleration sensors 10 and 11 are subtracted from each other as it will be discussed in more detail and justified below: The obtained results are evaluated with an aid of a model or rule-based algorithm that predicts the operational condition of the hand-held tool (hammer drill) M upon actuation of the acceleration sensors 1*a*, 1*b*. The present invention can be advantageously used in such cases in which no prediction of a to-be-expected twist angle of the hand-held tool M takes place. The invention can also be used with such safety devices which, based on an acceleration signal generated by stoppage of the working tool, are immediately actuated and, upon the signal exceeding a predetermined threshold, if necessary, after filtering of the disturbance signal and single and/or double integration, are used for triggering the drive breaker.

When an acceleration, which results from tool stoppage, is detected, and the acceleration is assessed by the evaluation device 3 as "dangerous", then via an output interface 4, the operation interrupting element, e.g., a coupling 5, is actuated. The coupling 5, interrupts the drive link between a drive motor 7 and the chuck or the working tool 8. If necessary, in addition, the output signal of the evaluation device 3 also actuates a current breaker 6.

The inventive method and the measurement system based thereon reliably operate for any arbitrary rotational axis of the entire system as well as, if necessary, for a tilted or furished working tool axis, as it would be explained below with reference to FIG. 3.

The movement measuring device has, as it has been discussed above, two acceleration sensors 1*a*, 1*b* the measurement signals of which, according to the invention, are subtracted from each other before being subjected to further processing. As can be seen from the following expression for two possible applications, the disturbance variable eliminates the acceleration caused by gravity in each application position of the electrical tool.

Figure 3:
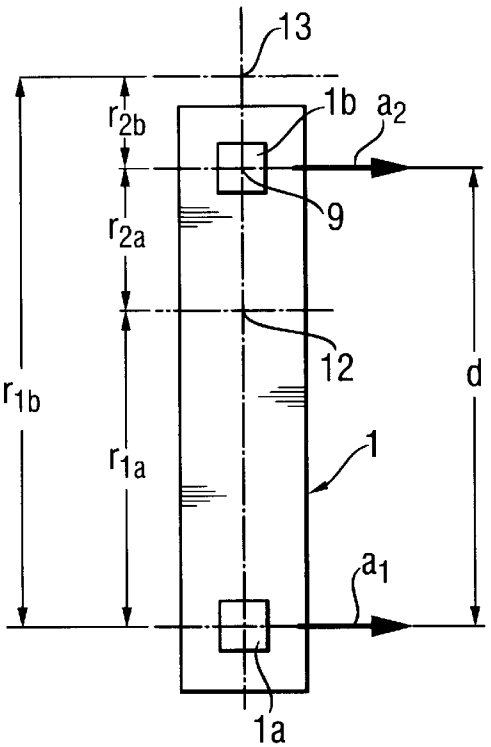
FIG. 3 a principle diagram of a rotational model for the hammer drill shown in FIGS. 1A and 1B with two, in the illustrated example, linear acceleration sensors.

According to FIG. 3, the second sensor 1*b* lies in a plane which includes, during a normal operation of the hand-held tool, the rotational axis 9. However, with the assumed two-dimensional sensor plane, the rotational axis can assume any arbitrary position and furnish always an error-cleared signal as could be seen from the mathematical expression below. In principle, more than two sensors can be provided, whereby the reliability of the obtained signal can be amplified by averaging or by a plausibility check. When two redundant sensor pairs are provided, intervals for the reliability check can be increased.

$a_1$, $a_2$ measurement signals of the first acceleration sensor 1*a* and the second acceleration sensor 1*b;* in particular $a_1$ and $a_2$ represent linear tangential accelerations about respective axes which below will be considered in detail as "Case 1" and "Case 2";

d=distance between the acceleration sensors 1*a*, 1*b;*

$r_{1a}$1, $r_{1b}$1=distance between the acceleration sensors 1*a*, 1*b* for the "Case 1" in which the (imaginary) rotational axis 12 of the tool, e.g., in case of tool stoppage, is displaced downwardly relatively to the drive axis or rotational axis 9 during a normal operation;

$r_{1a}$2, $r_{1b}$2=distance between the acceleration sensors 1*a*, 1*b* from an (imaginary axis for the "Case II", i.e.. when the axis 13 of the tool, in case of stoppage, is displaced upwardly relative to the drive axis or the rotational axis 9 during normal operation;

ϕ=expected twist angle in case of the tool stoppage.

Mathematical expression for "Case I":

$$\text{Rotational acceleration:}\quad \varphi = \frac{a_1}{r_{1al}} = -\frac{a_2}{r_{1bl}} \tag{1}$$

$$d = r_{1a1} + r_{1b1} \tag{2}$$

$$a_1 r_{1b1} = a_2 r_{1a1}$$

$$a_1 r_{1b1} + a_1 r_{1a1} = a_2 r_{1a1} + a_1 r_{1a1}$$

$$a_1(r_{1a1} + r_{1b1}) = r_{1a1}(a_1 - a_2)$$

$$\frac{a_1}{r_{1al}} = -\frac{a_1 - a_2}{r_{1al} + r_{1bl}} \tag{3}$$

Equation (3) put into equation (1) in connection with equation (2) gives an equation:

$$\text{Rotational acceleration}\quad \varphi = \frac{a_1 - a_2}{r_{1al} + r_{1bl}} = \frac{a_1 - a_2}{d} \tag{4}$$

As can be seen, the variable ϕ does not depend anymore on the acceleration due to gravity because the component of the gravity acceleration in both acceleration sensor signals $a_1$ and $a_2$ have the same value as can be seen in equation (4) and, thus, completely compensate each other.

Mathematical expression for "Case II":

$$\varphi = \frac{a_1}{r_{1a2}} = -\frac{a_2}{r_{1b2}} \tag{1'}$$

$$d = r_{1a2} + r_{1b2} \tag{2'}$$

$$a_1 r_{1b2} = a_2 r_{1a2}$$

$$a_1 r_{1b2} + a_1 r_{1a2} = a_2 r_{1a2} + a_1 r_{1a2}$$

$$a_1(r_{1a2} + r_{1b2}) = r_{1a2}(a_1 - a_2)$$

$$\frac{a_1}{r_{1a2}} = \frac{a_1 - a_2}{r_{1a2} - r_{1b2}} \tag{3'}$$

Equation (3') put into equation (1') in connection with the equation (2') gives an equation:

$$\varphi = \frac{a_1 - a_2}{r_{1a2} + r_{1b2}} = \frac{a_1 - a_2}{d} \tag{4'}$$

Also in "Case II", the available values of the measurement signals for signal evaluation, i.e., rotational accelerations are not anymore dependent from mass gravitation or gravity acceleration acting on the two sensors.

Within the scope of the present invention, in principle, any measurement system with acceleration sensors or acceleration pick-up is suitable for use in the inventive method. Thus, piezoelectrical, piezoresistive, or inertia-based systems and/or systems integrated as part of a microelectronic circuit can be used. The electronic evaluation device can be realized either as an analog device with an aid of operational amplifiers and corresponding filtering circuits, or as a digital device, using a microprocessor with associated interfaces. It is also possible to realize an evaluation system based on fuzzy logic.

For implementing the principles on which the present invention is based, in principle, each known measurement system for determination of acceleration, angular velocity or rotational angle can be used. In the above-discussed embodiment, for economical reasons, e.g., a piezoelectrical measurement method based on linear acceleration sensors is used. In principle, however measurement methods based on the use of trigger wheels and magnetic angular sensors, on micro mechanical acceleration sensors, and optical elements, magnetohydrodyhamic measurement method, rotational acceleration measurement method based on the Ferraris-principle, capacitance measurement method, and method based on wire strain gauge acceleration sensors can be used.

Though the present invention was shown and described with references to a preferred embodiment, such is merely illustrative of the present invention and is not to be construed as a limitation thereof and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. A method of preventing accidents caused by blockage of a rotatable tool when working with a hand-held tool including the rotatable tool (8), a drive motor (7) for driving the rotatable tool (8), and means (5, 6) for interrupting transmission of a drive torque from the drive motor (7) to the rotatable tool (8) dependent on an operational condition of the hand-held tool, the method comprising the steps of determining the operational condition of the hand-held tool by measuring displacement of the hand-held tool in space in at least two points of the hand-held tool spatially spaced from each other and spaced from a tool axis; subtracting two obtained displacement measurement variables ($a_1$, $a_2$) from each other, and thereafter, calculating an actuation signal that actuates the interrupting means (5, 6).

2. A method as set forth in claim 1, wherein the at least two points, in which the displacement of the hand-held tool in space is measured, are spaced from the tool axis at different distances.

3. A method as set forth in claim 1, wherein the operational condition determining step comprises measuring acceleration of the hand-held tool in space in the at least two points, so that the two displacement measurement variables ($a_1$, $a_2$) represent acceleration measurement variables.

4. A method as set forth in claim 3, comprising the steps of calculating in advance, after subtraction of the two acceleration measurement variables, based on a rotational acceleration variable obtained as a result of the subtraction, and on a predetermined time constant, an expected twist angle ($\phi$) of the hand-held tool; and actuating the interrupting means as soon as the calculated to-be-expected twist angle exceeds a predetermined maximum allowable twist angle.

5. An apparatus for preventing accidents caused by blockage of a rotatable tool when working with a hand-held tool including the rotatable tool (8), a drive motor (7) for driving the rotatable tool (8), and means (5, 6) for interrupting transmission of a drive torque from the drive motor (7) to the rotatable tool (8) dependent on an operational condition of the hand-held tool, the apparatus comprising at least two sensors located in a hand-tool housing and which are spatially spaced from each other and from a tool axis for measuring displacement of the hand-held tool in space in two points at which the sensors are located; and an electronic evaluation device (3) for processing displacement measurement variables ($a_1$, $a_2$) generated by the least two sensors and including a subtraction stage for subtracting the generated displacement measurement variables ($a_1$, $a_2$) from each other before calculating an actuation signal for actuating the interrupting means.

6. An apparatus as set forth in claim 5, wherein the at least two sensors are acceleration measuring sensors **(1*a*, 1*b*)** so that the generated displacement measurement variables ($a_1$, $a_2$) represent acceleration measurement variables.

7. An apparatus as set forth in claim 6, wherein the acceleration measuring sensors are formed as linear acceleration sensors.

8. An apparatus as set forth in claim 6, wherein at least one of the acceleration sensors generates, during a normal operational condition of the hand-held tool, a maximum output signal characterizing acceleration in a respective point of the hand-held tool.

* * * * *